US008733467B2

(12) United States Patent
Kandelin et al.

(10) Patent No.: US 8,733,467 B2
(45) Date of Patent: May 27, 2014

(54) ROCK DRILLING MACHINE AND AXIAL BEARING MODULE

(75) Inventors: Lars Kandelin, Tampere (FI); Timo Muuttonen, Siuro (FI); Pekka Saukko, Tottijärvi (FI)

(73) Assignee: Sandvik Mining and Construction Oy, Tampere (FI)

( * ) Notice: Subject to any disclaimer, the term of this patent is extended or adjusted under 35 U.S.C. 154(b) by 544 days.

(21) Appl. No.: 13/130,275

(22) PCT Filed: Nov. 17, 2009

(86) PCT No.: PCT/FI2009/050923

§ 371 (c)(1),
(2), (4) Date: May 19, 2011

(87) PCT Pub. No.: WO2010/058071

PCT Pub. Date: May 27, 2010

(65) Prior Publication Data

US 2011/0240322 A1 Oct. 6, 2011

(30) Foreign Application Priority Data

Nov. 20, 2008 (FI) ..... 20086098

(51) Int. Cl.

| | |
|---|---|
| ***B25D 9/14*** | (2006.01) |
| ***B25D 9/18*** | (2006.01) |
| ***B25D 9/26*** | (2006.01) |
| ***B25D 17/06*** | (2006.01) |

(52) U.S. Cl.

CPC .. *B25D 9/14* (2013.01); *B25D 9/18* (2013.01); *B25D 9/26* (2013.01); *B25D 17/06* (2013.01)

USPC ..... 173/104; 173/112; 173/114; 173/115; 173/212

(58) Field of Classification Search

CPC ..... B25D 9/14; B25D 9/18; B25D 9/26; B25D 17/06

USPC ..... 173/4, 104, 112, 114, 210, 212, 115; 175/414

See application file for complete search history.

(56) References Cited

U.S. PATENT DOCUMENTS

| | | | |
|---|---|---|---|
| 5,771,982 | A | 6/1998 | Briggs et al. |
| 6,273,199 | B1 | 8/2001 | Kiikka et al. |

(Continued)

FOREIGN PATENT DOCUMENTS

| | | |
|---|---|---|
| EP | 1 160 416 | 5/2001 |
| FI | 75028 C | 4/1988 |

(Continued)

OTHER PUBLICATIONS

European Search Report and Search Opinion for Application No. 09 82 7226 dated Sep. 12, 2013.

(Continued)

*Primary Examiner* — Michelle Lopez

(74) *Attorney, Agent, or Firm* — Morgan, Lewis & Bockius LLP

(57) ABSTRACT

A rock drilling machine equipped with an axial bearing having at least one axial piston for setting the axial position of a drill shank and for damping stress pulses returning from the rock. The axial bearing includes a module that is detachable in one piece from one installation direction. The axial bearing module includes all necessary seals, bearing surfaces, and a module frame. Supporting forces caused by the operation of the axial bearing are transmitted of support members in the module frame directly to the body of the rock drilling machine, which is a uniform piece at least at the axial bearing.

9 Claims, 5 Drawing Sheets

(56) References Cited

U.S. PATENT DOCUMENTS

| | | | | |
|---|---|---|---|---|
| 6,854,538 | B2 * | 2/2005 | Muuttonen | 175/414 |
| 7,032,684 | B2 * | 4/2006 | Muuttonen et al. | 173/4 |
| 7,234,548 | B2 | 6/2007 | Comarmond | |
| 7,419,015 | B2 | 9/2008 | Muuttonen et al. | |
| 2004/0112649 | A1 * | 6/2004 | Muuttonen | 175/414 |
| 2006/0213690 | A1 * | 9/2006 | Muuttonen et al. | 175/296 |
| 2011/0220421 | A1 | 9/2011 | Muuttonen et al. | |

FOREIGN PATENT DOCUMENTS

| | | | |
|---|---|---|---|
| FI | 108668 | B | 2/2002 |
| FI | 20030016 | A | 7/2004 |
| FR | 2 761 112 | | 9/1998 |
| JP | 8-511842 | | 12/1996 |
| JP | 2006-512217 | | 4/2006 |
| WO | WO 94/24403 | | 10/1994 |
| WO | WO 01/02691 | | 1/2001 |
| WO | WO 01/83170 | A1 | 11/2001 |
| WO | 03/078107 | | 9/2003 |
| WO | WO 2004/060617 | A1 | 7/2004 |
| WO | 2007/073275 | | 6/2007 |

OTHER PUBLICATIONS

Notice of Grounds for Rejection, with English translation, for Korean Application No. 2011-7014130, dated Apr. 29, 2013.

Search Report issued Sep. 4, 2009 in corresponding Finnish Patent Application No. 20086098 (In Finnish).

Office Action issued Sep. 7, 2009 in corresponding Finnish Patent Application No. 20086098 (In Finnish).

International Search Report mailed Feb. 26, 2010, issued in PCT/FI2009/050923.

* cited by examiner

ROCK DRILLING MACHINE AND AXIAL BEARING MODULE

CROSS REFERENCE TO RELATED APPLICATIONS

This application is the National Stage of International Application No. PCT/FI2009/050923, filed Nov. 17, 2009, and claims benefit of Finnish Application No. 20086098 filed Nov. 20, 2008, both of which are herein incorporated by reference in their entirety.

BACKGROUND OF THE INVENTION

The invention relates to a rock drilling machine that comprises a body, a percussion element arranged inside the body and, further, a drill shank, to which a tool may be attached for breaking rock. A percussion device comprises a percussion element that generates stress pulses through the shank to the tool. Further, the rock drilling machine comprises an axial bearing having one or more pressure medium-operated axial pistons, with which the shank may be pushed in the axial direction relative to the body a predefined travelling length toward the stroke direction. The impact surface of the shank may then be set at a required axial point for receiving stress pulses. The axial piston is operated by pressure medium, whereby it comprises a working pressure surface that is located in a working pressure space belonging to the axial bearing, to which the pressure of the pressure medium may be fed from a feed channel. A force may then be directed to the axial piston in the stroke direction. The invention also relates to an axial bearing module. The field of the invention is defined in more detail in the preambles of the independent claims of the patent application.

It is known to equip a rock drilling machine with an axial bearing, with which a drill shank belonging to the rock drilling machine may be moved to a planned impact point during drilling. The striking power may then be adjusted by adjusting the position of the drill shank. In addition, the axial bearing may be used to damp the stress pulses reflected back to the rock drilling machine from the rock. The axial bearing is typically positioned in an intermediate flange between the front body and back body of the rock drilling machine. A drawback with the known axial bearings is that the supporting forces caused by the operation of the axial bearing cause unnecessary strain on the structures of the rock drilling machine.

BRIEF DESCRIPTION OF THE INVENTION

It is an object of the invention to provide a novel and improved rock drilling machine and axial bearing module.

The rock drilling machine of the invention is characterised in that the axial bearing comprises at least one axial bearing module that comprises at least one axial piston, at least one seal, at least one bearing surface, and a module frame; that the outer surface of the module frame is equipped with at least one fixed support member for transmitting the supporting forces caused by the operation of the axial bearing directly from the axial bearing to the body of the rock drilling machine; and that the body of the rock drilling machine is at least at the axial bearing a uniform piece without joint surfaces.

The axial bearing module of the invention is characterised in that the axial bearing module comprises at least one axial piston, at least one seal, at least one bearing surface, and a module frame; that the axial bearing is a uniform piece that is detachable and installable in place into the rock drilling machine in one piece; and that the module frame is a sleeve-like piece and comprises on its outer rim at least one locking bracket for fastening the axial bearing module independently to the rock drilling machine.

The idea of the invention is that the axial bearing of the rock drilling machine comprises one or more axial bearing modules that are detachable and installable in place in the space in the body in one piece. The axial bearing module comprises one or more axial pistons, one or more bearing surfaces, seals, and a module frame. Further, the supporting forces caused by the operation of the axial bearing are transmitted directly to the uniform body part of the rock drilling machine by means of at least one locking member in the module frame. Said uniform body part does not have any joint surfaces at the axial bearing.

The invention provides the advantage that the axial bearing module comprises in one uniform entity all essential components necessary for the operation of the axial bearing. The axial bearing module may conveniently be detached in one entity and replaced by a new one. Further, worn seals and possibly also bearings may be detached and replaced in the repair shop in good conditions. Because supporting forces are transmitted from the axial bearing module to one uniform body part, there are no joint surfaces at the axial bearing. This way, it is possible to avoid the problems that occurred in the prior-art solutions and were caused by the strain and wear directed to the joint surfaces and the loads directed to joint members, such as tie bolts. The structure of the invention may thus be more robust and stronger than the earlier solutions.

The idea of an embodiment is that the body of the rock drilling machine is one single uniform piece with no joint surfaces. A one-piece structure does not have joint surfaces and tie bolts between parts thereof, to which loads are directed by the supporting forces caused by the axial bearing. A one-body rock drilling machine may thus be stronger and more maintenance-free than before. In addition, it may be lighter and shorter. It should be noted that a flushing chamber possibly located at the front end of the body and a back cover or pressure accumulator at the back end are not part of the body.

The idea of an embodiment is that the body of the rock drilling machine is formed of two or more inter-connected body parts. However, the joints between the body parts are not at the axial bearing or under the effect of the supporting forces so that no supporting forces caused by the operation of the axial bearing are directed to the joints. A uniform structure along the axial bearing receives the opposite-direction supporting forces and transmits them onward as necessary.

The idea of an embodiment is that the axial bearing module is detachable and installable in place in one piece in a space located in the body without needing to dismantle the body parts of the rock drilling machine. Because the body of the rock drilling machine need not be dismantled when installing the axial bearing module, minor maintenance, component replacements, and other repairs of the axial bearing may be done on work site and without needing to detach the rock drilling machine from the feed beam.

The idea of an embodiment is that the axial bearing module is arranged in place from the front end of the rock drilling machine. Support members in the module frame are then arranged to transmit the axial supporting forces caused by the axial bearing and acting in the stroke direction directly to the body of the rock drilling machine. Thus, the support members transmit at least the supporting forces that are opposite to the installation direction.

The idea of an embodiment is that the axial bearing module is arranged in place from the back end of the rock drilling machine. Support members in the module frame are then arranged to transmit the axial supporting forces caused by the axial bearing and acting in the return direction directly to the body of the rock drilling machine. Thus, the support members transmit at least the supporting forces that are opposite to the installation direction.

The idea of an embodiment is that the support members in the module frame are arranged to transmit the supporting forces caused by the axial bearing both in the stroke and return directions.

The idea of an embodiment is that one or more axial bearing modules are fastened to the body of the rock drilling machine by means of one or more form-locking members. The form-locking member is formed in the module frame.

The idea of an embodiment is that one or more axial bearing modules are fastened to the body of the rock drilling machine by means of bayonet-fastening.

The idea of an embodiment is that the module frame of at least one axial bearing module is furnished with at least one support surface, support shoulder, support flange or corresponding member, with which the supporting forces caused by the operation of the axial bearing may be transmitted directly to the body of the rock drilling machine. The support shoulder in the module frame may then transmit the supporting forces in a first direction and the support surface may transmit the supporting forces in a second, opposite direction.

The idea of an embodiment is that the axial bearing comprises at least two axial bearing modules arranged one after the other in the axial direction. The frame of each module may comprise its own support brackets or the like.

The idea of an embodiment is that the axial bearing comprises at least two consecutive axial bearing modules, of which the module installed last, that is, the outermost module is arranged to lock the other modules in place in the axial direction. The module frame of the outermost module is furnished with a locking bracket that transmits supporting forces to the body and locks the modules in place.

The idea of an embodiment is that the outer surface of the module frame is furnished with a thread that is arranged to lock into the body of the rock drilling machine, when the module frame is turned around its centre axis. The thread then acts as a locking member that may transmit at least the supporting forces opposite to the installation direction to the body of the drilling machine.

BRIEF DESCRIPTION OF THE FIGURES

Some embodiments of the invention are described in greater detail in the attached drawings, in which.

In the figures, some embodiments of the invention are shown simplified for the sake of clarity. Similar parts are marked with the same reference numbers in the figures.

DETAILED DESCRIPTION OF SOME EMBODIMENTS OF THE INVENTION

Figure 1:
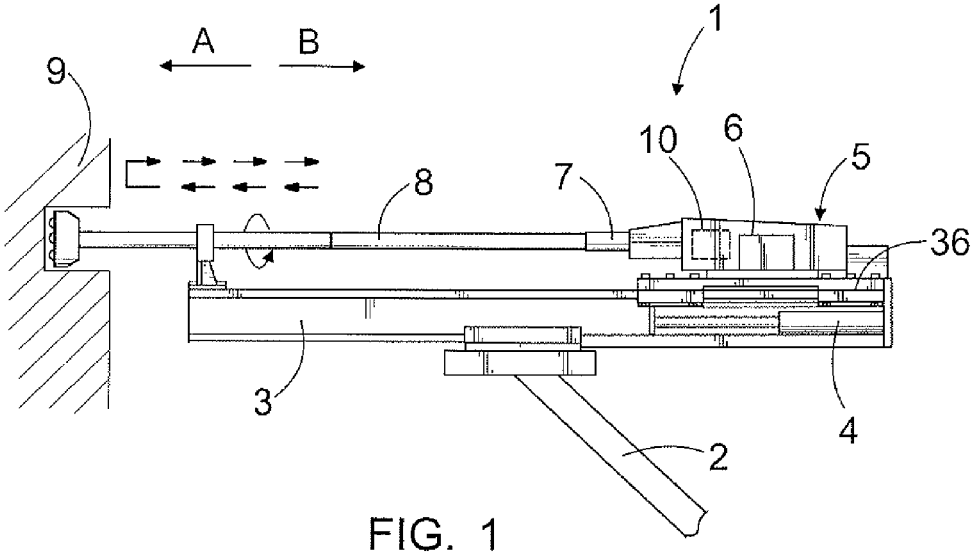
FIG. 1 is a schematic side representation of a rock drilling unit arranged on a drilling boom.

FIG. 1 shows a rock drilling unit 1 that may be arranged on the drilling boom 2 or the like of a rock drilling rig. The rock drilling unit 1 may comprise a feed beam 3, on which a rock drilling machine 5 is arranged and moved by means of a feed device 4. The rock drilling machine 5 may be fastened to a carriage 36 and may be moved in the stroke direction A and return direction B. In addition, the rock drilling machine 5 comprises a percussion device 6 for generating impact pulses to a drill shank 7 and further through a tool 8 to the rock 9. The tool 8 may comprise one or more drill rods and a drill bit. Alternatively, the tool 8 may be an integral rod, in which case a machine member like the drill shank 7 may be thought to be fixedly connected to its rock drilling machine side end. Thus, a drill shank in this patent application may also refer to the back end of an integral rod or the like, on which the axial bearing may act. Further, the rock drilling machine 5 may comprise a rotating device 10 for rotating the drill shank 7 and tool 8 around its longitudinal axis. The drill shank 7 is arranged to transmit impact, rotation and feed forces to the drilling tooling that transmits them on to the rock 9 being drilled.

The percussion device 6 may comprise a percussion piston that is moved back and forth by means of a pressure medium and is arranged to strike in the stroke direction A the impact surface on the drill shank 7. Instead of the percussion piston, it is possible to use any other percussion member or element for generating impact pulses. Impact pulses need not necessarily be generated from kinetic energy, but they may also be generated directly from pressure energy, for example. Further, instead of pressure energy, the energy required for generating impact pulses may also be some other energy, such as electric energy. Thus, it may be stated that the structure and operational principle of the percussion device are not essential issues for the invention being discussed.

Figure 2:
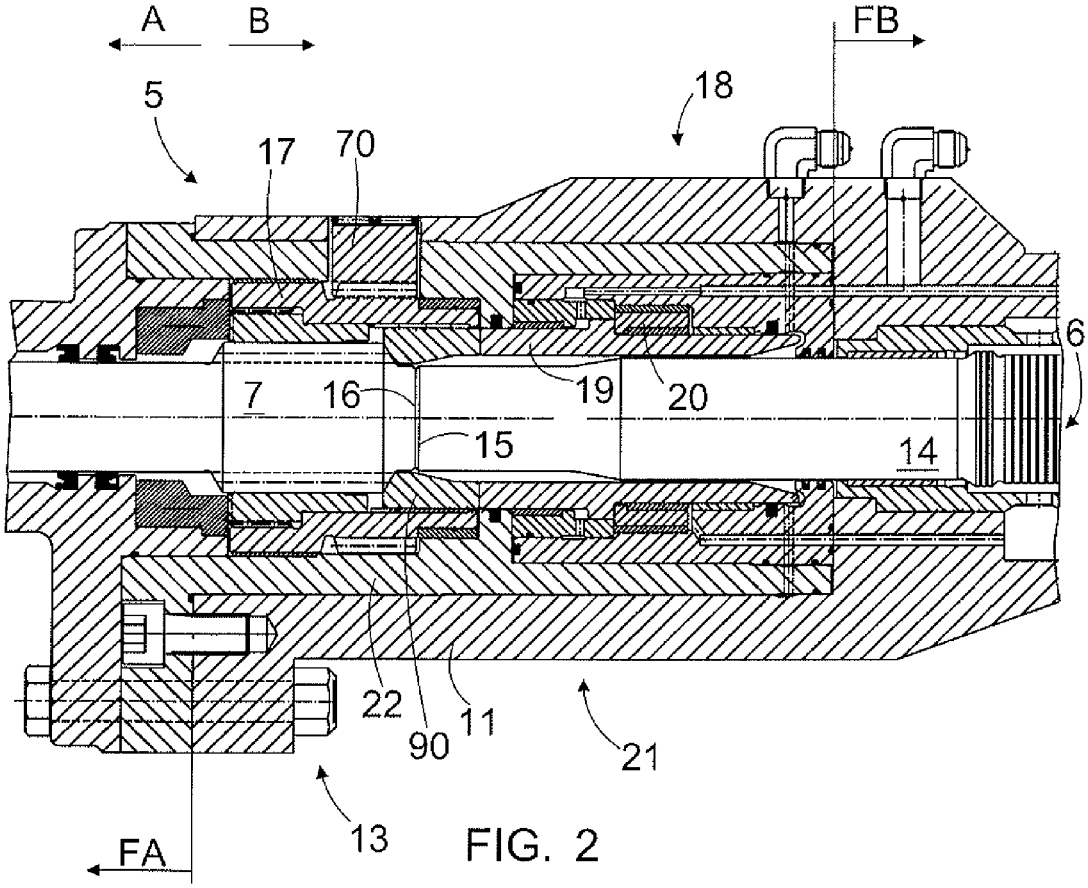
FIG. 2 is a schematic sectional representation of a part of the rock drilling machine according to FIG. 3.
Figure 3:
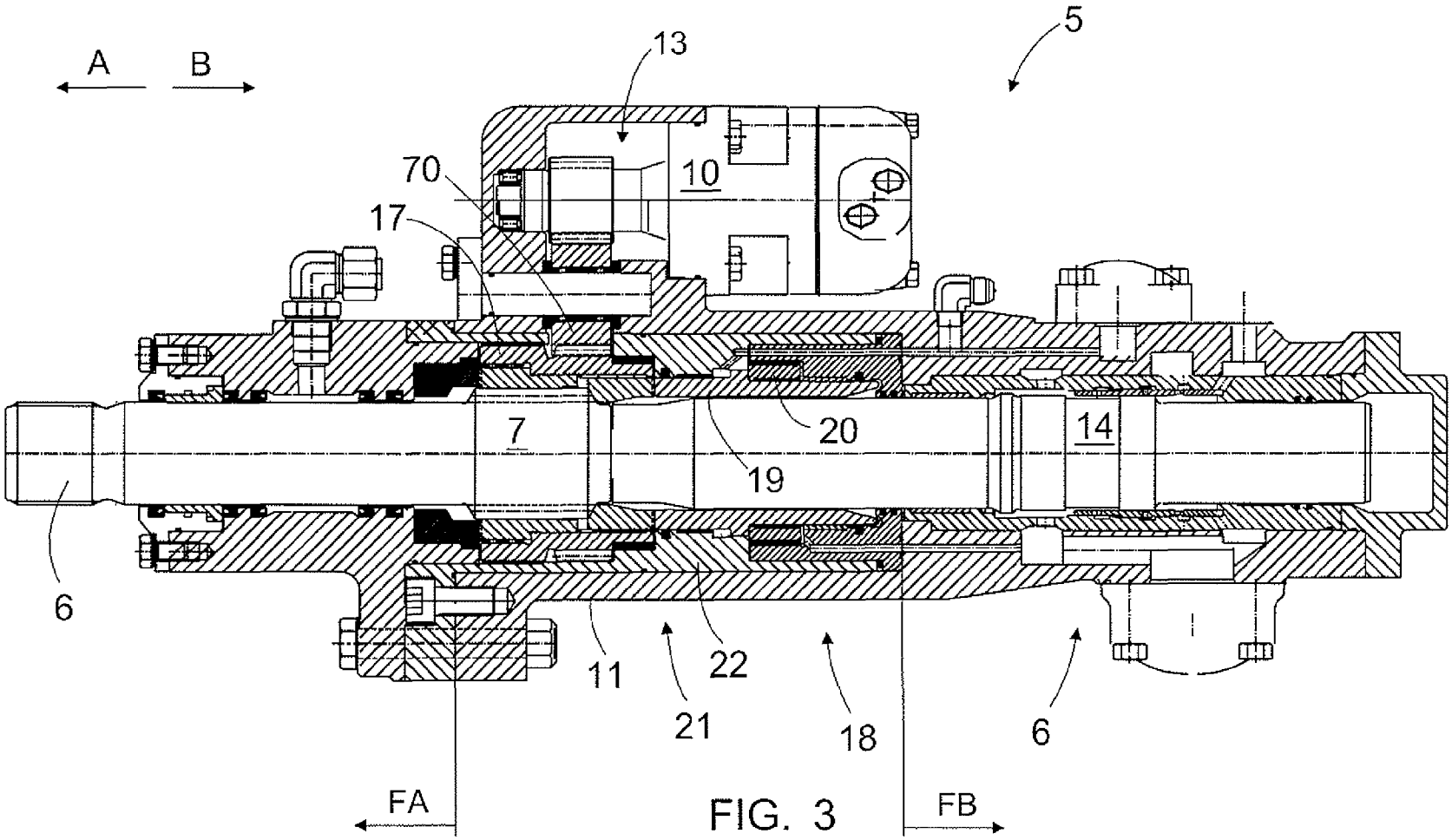
FIG. 3 is a schematic sectional representation of a rock drilling machine equipped with an axial bearing module.

The construction and operation of the rock drilling machine and axial bearing are described in general by means of FIGS. 2 and 3. An embodiment of the invention is shown later in FIGS. 4 to 8. However, it should be mentioned that the features mentioned in the description of FIGS. 2 and 3 may also be applied to the solution of the invention as necessary.

The rock drilling machine 5 shown in FIGS. 2 and 3 has one body, in other words, it comprises one single uniform body 11. The body 11 may be a tubular piece with a percussion device 6, axial bearing 18, rotating device gear system 13 and drill shank 7 arranged inside it. The percussion device 6 comprises a percussion member 14 that may be a percussion piston arranged to move in the axial direction back and forth by means of pressure medium, for example, so that the impact surface 15 at the front end of the percussion member 14 is arranged to strike the impact surface 16 at the back end of the drill shank 7. It should be mentioned that in this patent application, the front end of the components of the rock drilling machine 5 refers to the stroke-direction A side end and, correspondingly, the back end of the components refer to the return-direction B side end. Surrounding the drill shank 7, there may be a rotating sleeve 17 belonging to the gear system 13 for transmitting the rotation torque provided by the rotating device 10 to the drill shank 7. The connection between the drill shank 7 and rotating sleeve 17 allows the drill shank 7 to move in the axial direction. An intermediate gear 70 may be positioned between the rotating device 10 and rotating sleeve 17.

The axial-direction position of the drill shank 7 may be acted on by an axial bearing 18 that may comprise one, two, or more pistons movable in the axial direction. The drill shank 7 may be supported from its rear side by means of a first axial piston 19. The axial piston 19 may be arranged to act on the drill shank 7 directly or through a support sleeve 90. The first piston 19 may be a sleeve-like piece that may be arranged around the percussion member 14. Further, a sleeve-like second axial piston 20 may be positioned around the first piston 19. The pistons 19 and 20 may be moved in the axial direction relative to each other, when pressure fluid pressure is directed into their pressure chambers. The movement of the second piston 20 in the stroke direction A may be dimensioned shorter than that of the first piston 19. The movement of the first piston 19 in the stroke direction A may be dimensioned so that the impact surface 16 of the drill shank may be moved to be in front of the planned impact point, when feed resistance becomes smaller, whereby a damper in connection with the percussion member 14 may reduce the strike force transmitted to the tool 8 when soft rock is drilled, for instance. Further, the common force of the axial pistons 19, 20 in the stroke direction A may be dimensioned to be greater than the feed force. Alternatively, the force effect of one axial piston alone is dimensioned greater than the feed force. With the axial pistons 19, 20, it is possible not only to influence the axial position of the impact point but also dampen the return movement caused by the stress pulses returning from the rock. When the above-mentioned return movement is directed to the axial pistons 19, 20, the pressure fluid releasing from the pressure chambers of the pistons is led through suitable throttle means to provide the damping. As regards the general operational principle and structure of the axial bearing, we refer to what is stated in publications FI 84 701, FI 20 030 016, and U.S. Pat. No. 6,186,246 and declare that the matters stated therein are also included in this patent application.

FIG. 2 shows the points, at which the supporting forces caused by the operation of the axial bearing are transmitted to the body 11. The supporting forces FA acting in the stroke direction are transmitted by means of the fastening flange 23 and the supporting forces FB acting in the return direction are transmitted by means of the shoulder 74.

Figure 4:
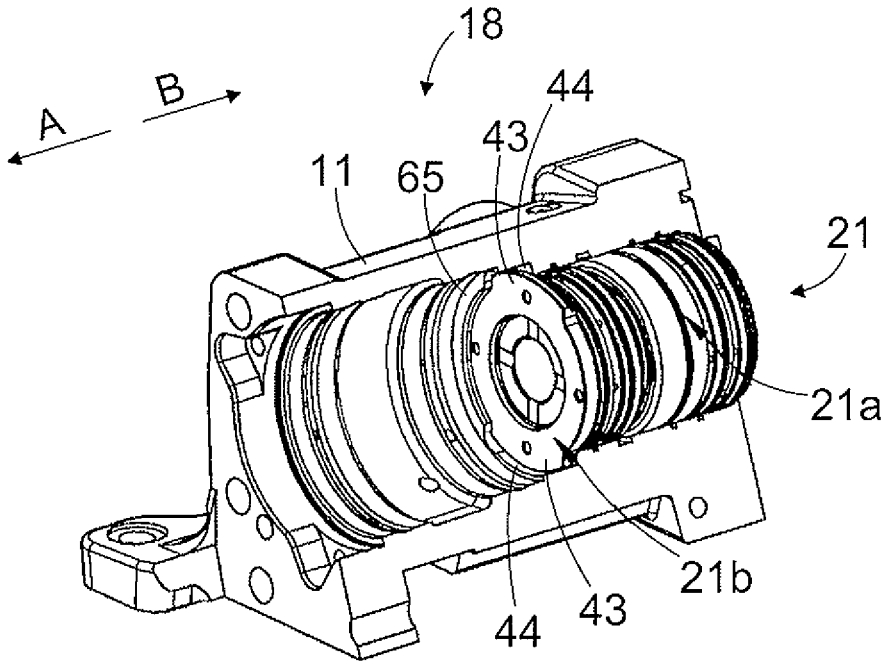
FIGS. 4 to 7 are schematic, sectional, and perspective representations of the structure of an axial bearing module of the invention and its installation and locking on to the body of a rock drilling machine.
Figure 5:
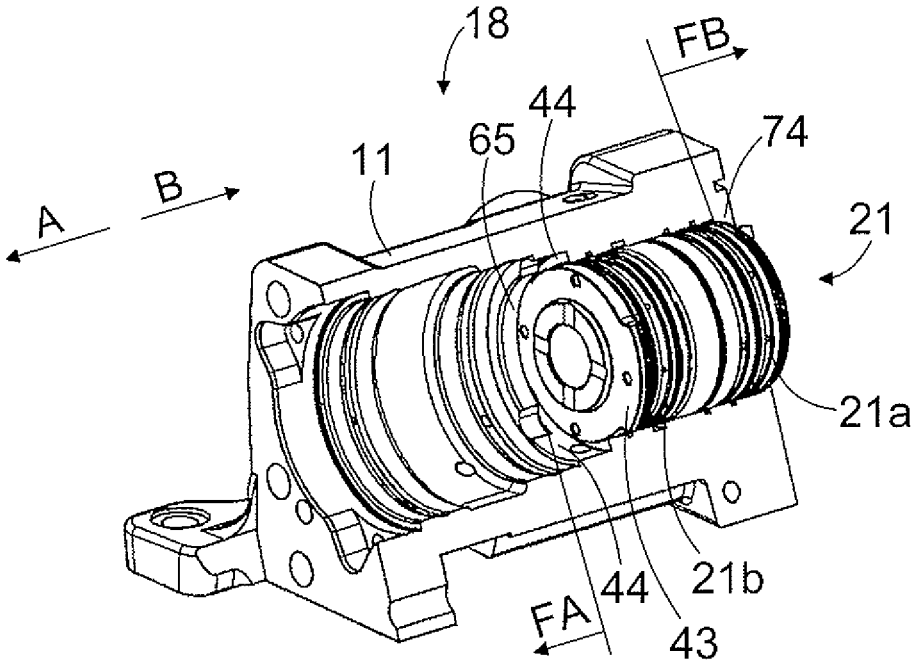

FIGS. 4 to 8 show an alternative axial bearing 18 of the invention that comprises a first axial bearing module 21*a* and a second axial bearing module 21*b* that are arranged consecutively in the axial direction inside the body 11 from one installation direction, in this case from the front end of the rock drilling machine 5, after the flushing chamber 31, drill shank 7, rotating sleeve 17 and other possible components in front of the axial bearing 18 have been detached. The body 11 that in FIGS. 4 to 7 is shown only partly for the sake of clarity is at least along the section of the axial bearing 18 a uniform piece with no joint surfaces that the supporting forces caused by the axial bearing 18 could load. As can be seen more clearly in FIG. 8, the first axial bearing module 21*a* comprises a module frame 38*a*, axial piston 39*a*, bearings 40*a*, bearing housings 41*a*, and a seal 42*a*. The first axial bearing module 21*a* may be installed in place and detached in one uniform piece. After the first axial bearing module 21*a* is pushed in place, the second axial bearing module 21*b* may be arranged in the same installation direction in the manner shown in FIG. 4. It is also possible to install and remove the axial bearing modules 21*a* and 21*b* together simultaneously. The second axial bearing module 21*b* correspondingly comprises a module frame 38*b*, axial piston 39*b*, bearing 40*b*, bearing housing 41*b*, and seal 42*b*. Both axial bearing modules 21*a*, 21*b* are thus pieces that are easy to handle, detach and install. As can be seen in FIG. 4, the module frame 38*b* of the second axial bearing module 21*b* may comprise one or more locking brackets 43 that may be pushed inside openings 44 in the body 11 during installation. When the second axial bearing module 21*b* is then turned in the manner shown in FIG. 5 around its longitudinal axis at a limited angle, the locking brackets 43 move away from the openings 44 and lock against the locking surfaces or shoulders 65 on the body 11. The fastening of the second axial bearing module 21*b* may thus be by bayonet-locking. Naturally, it is also possible to use other fixed form-locks formed on the body or other integral fastening members. The second axial bearing module 21*b* also locks the first axial bearing module 21*a* in place, whereby the first axial bearing module 21*a* need not necessarily be furnished with fastening members, though this is naturally possible. The supporting forces FA and FB caused by the operation of the axial bearing 18 are transmitted by means of the locking bracket 43 or corresponding fastening means and the shoulder 74 directly to the body 11 of the rock drilling machine.

Figure 6:
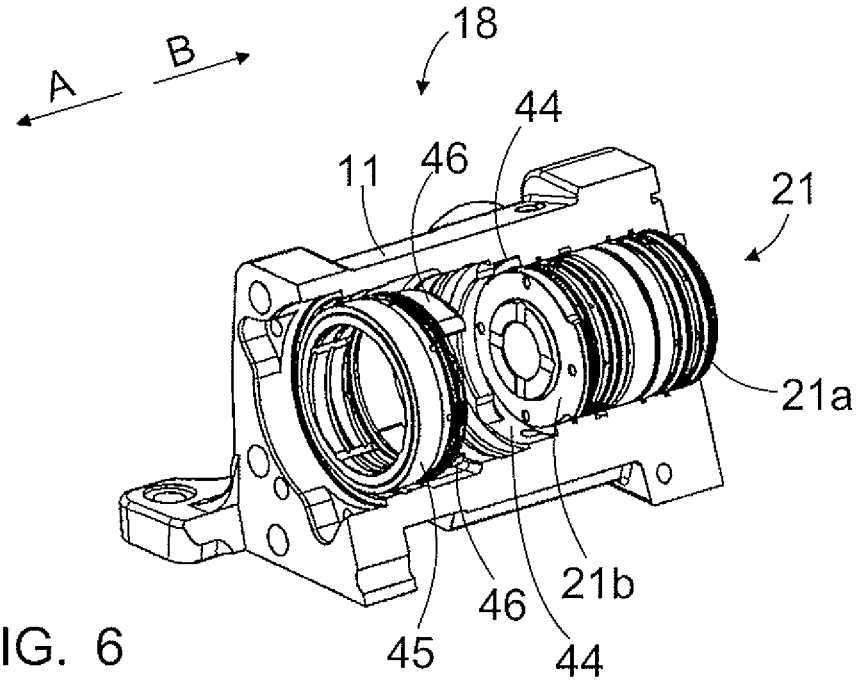
Figure 7:
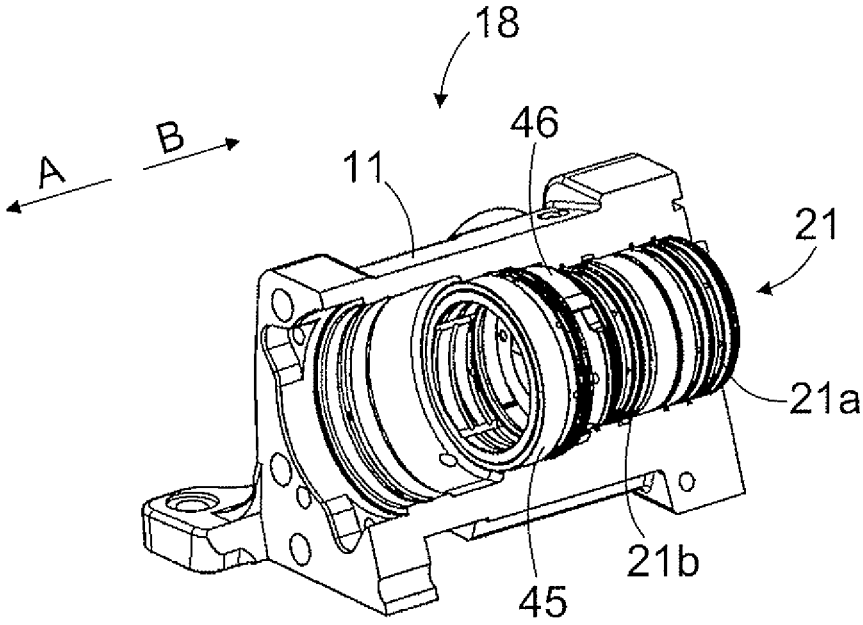
Figure 8:
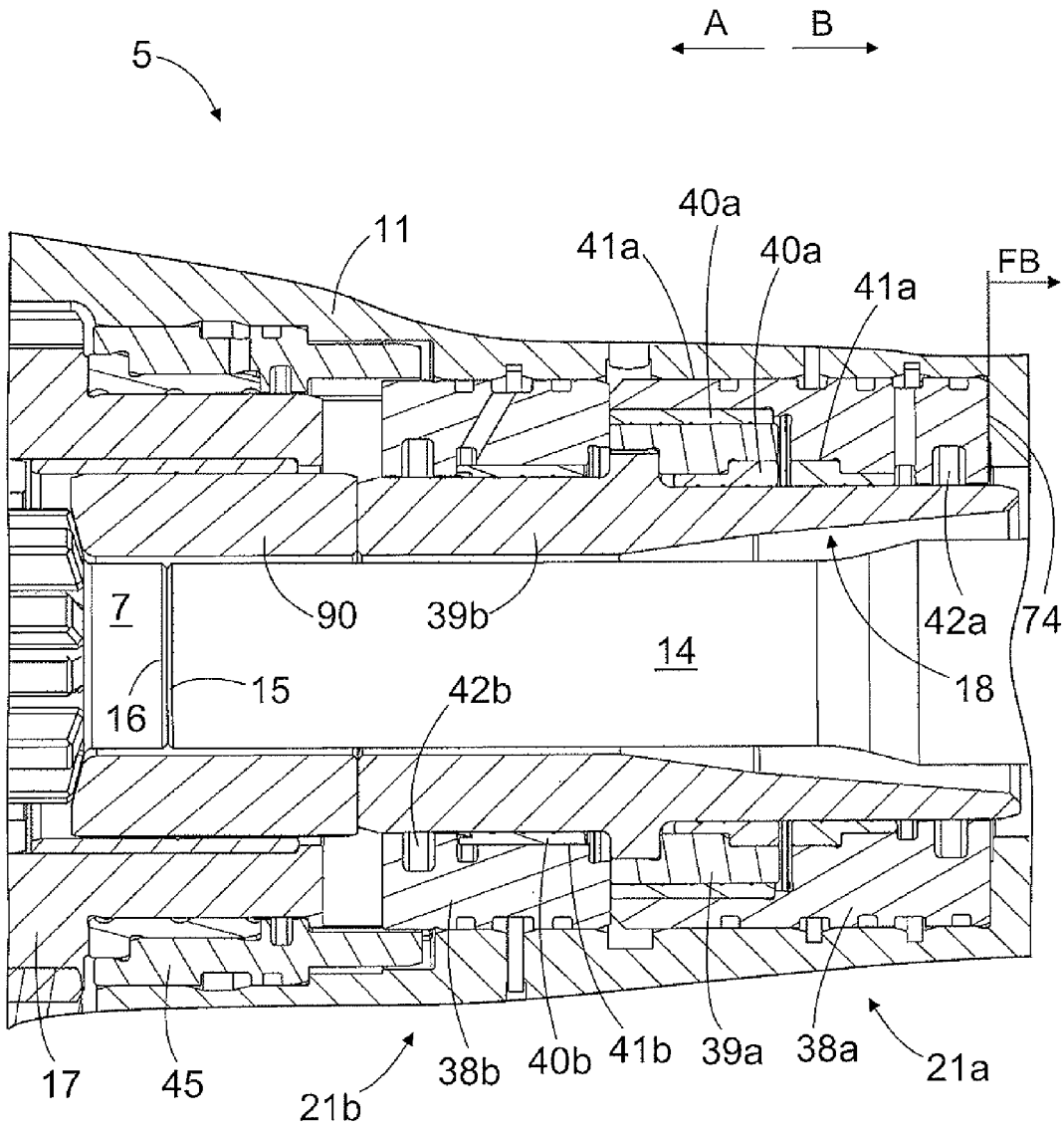
FIG. 8 is a schematic and sectional representation of a rock drilling machine that is equipped with the axial bearing module of FIGS. 4 to 7.

FIGS. 6 and 7 show that the rotation of the second axial bearing module 21*b* around its longitudinal axis may be prevented with a bearing sleeve 45. The bearing sleeve 45 may comprise axial-direction brackets 46 at the openings 44 in the body 11. When the bearing sleeve 45 is pushed in place in the axial direction, the brackets 46 push into the openings 44 and lock the second axial bearing module 21*b* against turning. In the cross-sectional view of FIG. 8, this locking arrangement is not visible. The bearing sleeve 45 may comprise a bearing for fitting the rotating sleeve 17 with bearings.

One embodiment of the axial bearing 18 shown in FIGS. 4 to 8 may be one with only one axial bearing module 21. Further, another embodiment may comprise one or two axial bearing modules 21*a*, 21*b* that are mounted in the space in the body 11 through the back end of the rock drilling machine 5, that is, breech-loaded. Further, both axial bearing modules 21*a*, 21*b* may be equipped with their own locking brackets or corresponding support members for transmitting supporting forces to the body of the rock drilling machine.

It is also possible to use, instead of a one-piece body 11, a body made up of two or more body parts, but then the point of contact between the body parts is preferably located so that the supporting forces caused by the operation of the axial bearing 18 will not pass the point of contact between the body parts. Thus, the point of contact should reside outside the section between points FA and FB. This way, it is possible to avoid loading the points of contact and the fastening bolts of the body parts.

It should be mentioned that the module frame may be equipped with a bearing that is made of bearing metal, such as bearing bronze, and arranged in the module frame by welding or casting, for instance. The module frame then does not have an actual bearing housing for the separate bearing member, but it has a type of integrated structure. Further, it is possible to form the required bearing surfaces by using a suitable coating. The bearing surface of the axial bearing module may thus be formed of a separate bearing piece, a slide bearing integrated into the module frame, or a bearing coating.

In some cases, the features disclosed in this patent application may be used as such, regardless of other features. On the other hand the features disclosed in this patent application may, when necessary, be combined to form various combinations.

The drawings and the related description are only intended to illustrate the idea of the invention. The invention may vary in detail within the scope of the claims.

The invention claimed is:

1. A rock drilling machine that comprises:

a body;

a percussion device that comprises a percussion element for generating stress pulses;

a drill shank that is an elongated piece arranged in front of the percussion element in a stroke direction, the drill shank having an impact surface for receiving said stress pulses and, further, the drill shank being movable in an axial direction relative to the body; and an axial bearing that comprises at least one pressure medium-operated axial piston by means of which the drill shank is pushed in the axial direction relative to the body a predefined travelling length toward the stroke direction, whereby the impact surface of the drill shank is settable at a required axial point for receiving stress pulses, wherein the axial piston comprises at least one working pressure surface located in at least one working pressure space belonging to the axial bearing, to which pressure of the pressure medium is fed from at least one feed channel, whereby a force in the stroke direction is directable to the axial piston, wherein the axial bearing comprises at least one axial bearing module that comprises the at least one axial piston, at least one seal, at least one bearing surface, and a module frame, wherein an outer surface of the module frame is furnished with at least one fixed support member for transmitting supporting forces caused by operation of the axial bearing directly from the axial bearing to the body of the rock drilling machine, and wherein the body of the rock drilling machine is at least at the axial bearing a uniform piece without joint surfaces.

2. A rock drilling machine as claimed in claim 1, wherein the module frame is fastened to the body of the rock drilling machine with form-locking.

3. A rock drilling machine as claimed in claim 1 wherein the module frame is a sleeve-like piece, an outer rim of the module frame has at least one locking bracket, the body of the rock drilling machine has at least one locking shoulder, and said locking bracket is arranged to lock into said locking shoulder after the axial bearing module is pushed in place in the axial direction and turned around a longitudinal axis of the axial bearing module at a limited angle.

4. A rock drilling machine as claimed in claim 1, wherein the body of the rock drilling machine is one single uniform piece.

5. A rock drilling machine as claimed in claim 1, wherein the body of the rock drilling machine is formed of at least two interconnected body parts with joint surfaces between them, and the axial bearing module is detachable and installable in place in one piece without dismantling the body of the rock drilling machine.

6. A rock drilling machine as claimed in claim 1, wherein the axial bearing module is detachable and installable in place in one piece from the direction of the drill shank, and the support member of the module frame is arranged to transmit axial forces caused by the axial bearing and acting in the stroke direction directly to the body of the rock drilling machine.

7. A rock drilling machine as claimed claim 1, wherein the axial bearing module is detachable and installable in place in one piece from the direction opposite to the drill shank, and the support member of the module frame is arranged to transmit axial forces caused by the axial bearing and acting in a return direction directly to the body of the rock drilling machine.

8. A rock drilling machine as claimed in claim 1, wherein the axial bearing comprises at least two consecutive axial bearing modules that are arranged in an axial installation direction in a space in the body;

a last installed outermost axial bearing module is arranged to lock a remainder of the axial bearing modules in place in the axial direction; and the module frame of the outermost axial bearing module has at least one support member that is arranged to transmit the supporting forces caused by operation of the at least two consecutive axial bearing modules to the body in a direction opposite to the axial installation direction of the axial bearing modules.

9. An axial bearing module of a rock drilling machine, which comprises at least one pressure medium-operated axial piston, by means of which a drill shank of the rock drilling machine is pushed in an axial direction relative to the body of the rock drilling machine a predefined travelling length toward a stroke direction, whereby an impact surface of the drill shank is settable at a required axial point for receiving stress pulses, the axial bearing module comprising:

the at least one axial piston, at least one seal, at least one bearing surface, and a module frame, wherein the axial bearing module is a uniform piece that is detachable and installable in place into the rock drilling machine in one piece, and wherein the module frame is a sleeve-like piece and comprises on an outer rim at least one locking bracket for fastening the axial bearing module independently to the rock drilling machine.

* * * * *